US007322224B2

(12) United States Patent
Ohashi et al.

(10) Patent No.: US 7,322,224 B2
(45) Date of Patent: Jan. 29, 2008

(54) DRAWING METHOD AND DRAWING DIE ASSEMBLY

(75) Inventors: Koji Ohashi, Aichi-ken (JP); Takayoshi Mori, Toyohashi (JP); Michio Yamada, Shinshiro (JP); Koji Ooi, Toyokawa (JP); Hisashi Yasumatsu, Toyokawa (JP); Toshio Naiki, Toyokawa (JP); Hiromu Nakamura, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 240 days.

(21) Appl. No.: 10/764,536

(22) Filed: Jan. 27, 2004

(65) Prior Publication Data

US 2005/0056073 A1 Mar. 17, 2005

(30) Foreign Application Priority Data

Sep. 17, 2003 (JP) ..... 2003-324502

(51) Int. Cl.
*B21D 31/00* (2006.01)

(52) U.S. Cl. ..... 72/379.2; 72/350

(58) Field of Classification Search ..... 72/343, 72/348, 350, 351, 352, 379.2
See application file for complete search history.

(56) References Cited

U.S. PATENT DOCUMENTS 4,113,522 A * 9/1978 Hamilton et al. ..... 72/358
5,755,134 A * 5/1998 McEldowney ..... 72/356
7,082,808 B2 * 8/2006 Knaup ..... 72/352

FOREIGN PATENT DOCUMENTS

| | | | |
|---|---|---|---|
| JP | 2-192826 A | | 7/1990 |
| JP | 2192826 | * | 7/1990 |
| JP | 6-55231 A | | 3/1994 |
| JP | 2000-225421 A | | 8/2000 |
| JP | 2002-316226 | * | 4/2001 |
| JP | 2002-316226 | | 10/2002 |

OTHER PUBLICATIONS

Notification of Reasons for Refusal dated Aug. 15, 2005, directed to counterpart Japanese Application No. 2003-324502.

* cited by examiner

*Primary Examiner*—Ed Tolan
(74) *Attorney, Agent, or Firm*—Morrison & Foerster LLP

(57) ABSTRACT

A drawing method for forming a reflective curved surface by pressing a metal plate fitted in a fixed die with a movable die. The fixed die is composed of a lower die and a core, and the movable die is composed of an upper die and a presser. During the drawing, the metal plate is pressed to have a compressed border portion between a non-pressed portion and a curved surface pressed portion. It is the most desirable to compress the border portion to have a thickness which is 70% of the thickness of the metal plate before drawing.

5 Claims, 4 Drawing Sheets

DRAWING METHOD AND DRAWING DIE ASSEMBLY

This application is based on Japanese application No. 2003-324502 filed on Sep. 17, 2003, the content of which is hereby incorporated by reference.

BACKGROUND OF THE INVENTION

1. Field of the Invention

The present invention relates to a drawing method, and more particularly to a drawing method for forming a reflective curved surface by pressing a metal plate and a die assembly which is suited to be used to carry out the drawing method.

2. Description of Related Art

In a printer which also has an image forming function by use of a laser beam, generally, a laser beam modulated in accordance with image data is imaged on a photosensitive member, and the modulation/imaging of a laser beam is carried out line by line. In this way, a two-dimensional image is formed.

In the image forming operation, before a start of modulation, the laser beam is incident to a photosensor which outputs an SOS (start of scanning) signal to time a start of writing of each line. For this purpose, conventionally, a structure as shown by FIG. 8*a* has been adopted, in which a laser beam L is reflected by a plane mirror 1 and converged on a sensor 3 by a lens 2. In the structure in which the plane mirror 1 and the lens 2 are used, the number of components is large, and the number of places to be adjusted is large. Therefore, this structure is not preferable.

In order to solve the problem, a structure as shown by FIG. 8*b* is adopted, in which a laser beam L is reflected and converged by a converging mirror 5. This mirror 5 has a reflective surface which also has an accurate converging function, and the reflective/converging surface is made by vapor-depositing a metal on a surface of a core which is a resin mold.

However, there are the following problems in forming the reflective/converging surface. It is very costly to form a coating on a surface of a resin mold by vapor deposition. The yield in the cycle of making resin molds and coating the resin molds by vapor deposition is bad, and it is always necessary to produce more than the necessity, which may result in too large a stock of products.

Meanwhile, Japanese Patent Laid-Open Publication No. 2002-316226 discloses a method of forming a reflective optical element from a metal plate by drawing. By this method, it is possible to form an optical element at low cost. However, there are still problems. The reflective surface made by this method is not very accurate due to spring kick at a bent portion. A complex die is necessary, and the productivity is low.

SUMMARY OF THE INVENTION

An object of the present invention is to provide a drawing method which permits production of an accurate reflective/converging surface.

Another object of the present invention is to provide a simple die assembly which heightens the productivity and which permits accurate processing of a reflective surface.

In order to attain the objects, a drawing method according to a first aspect of the present invention is a drawing method for forming a reflective curved surface by pressing a metal plate fitted in a fixed die with a movable die, and in the method, the metal plate is pressed so as to have a compressed border portion between a non-pressed portion and a reflective curved surface pressed portion.

In the drawing method according to the first aspect of the present invention, a metal plate which is a workpiece is pressed such that a border portion between a non-pressed portion and a reflective curved surface pressed portion, that is, a bent portion is compressed. Thereby, the amount of spring back in the border portion is substantially even, and consequently, a highly accurate reflective curved surface can be produced. A mirror which has a reflective curved surface produced by this method is suited to be used as a converging mirror for directing a laser beam to a photosensor.

The reflective curved surface may be a spherical surface, an aspherical surface or a cylindrical surface. By using an aluminum alloy plate as the metal plate, an efficient and accurate reflective surface can be obtained.

When the border portion is compressed to have a thickness which is at least 70% and most desirably 70% of the thickness of the metal plate before drawing, a highly accurate reflective curved surface can be obtained.

A drawing die assembly according to a second aspect of the present invention comprises: a fixed die and a movable die opposing each other, which are arranged to press a metal plate fitted in the fixed die with the movable die; and a compressing portion for forming a compressed border portion of the metal plate between a non-pressed portion and a reflective curved surface pressed portion.

By using the drawing die assembly according to the second aspect of the present invention, the amount of spring back at the border portion of the metal plate is even, and an accurate reflective curved surface can be obtained.

The die assembly according to the second aspect of the present invention can be of a simple structure. For example, the fixed die may be composed of a lower die and a core, and the movable die is composed of an upper die and a presser. Accordingly, by use of the die assembly, optical elements which have reflective surfaces can be produced efficiently.

BRIEF DESCRIPTION OF THE DRAWINGS

These and other objects and features of the present invention will be apparent from the following description with reference to the accompanying drawings, in which.

DETAILED DESCRIPTION OF THE PREFERRED EMBODIMENTS

Preferred embodiments of a drawing method and a drawing die assembly are described with reference to the accompanying drawings.

Figure 1:
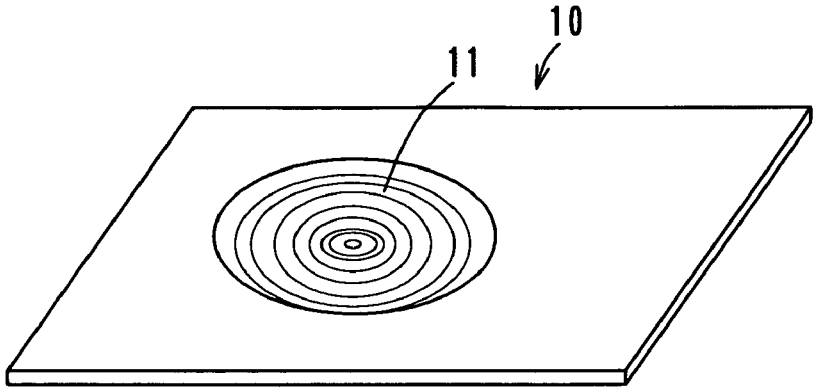
FIG. 1 is a perspective view of an exemplary mirror which is produced by a drawing method according to the present invention.
Figure 8A:
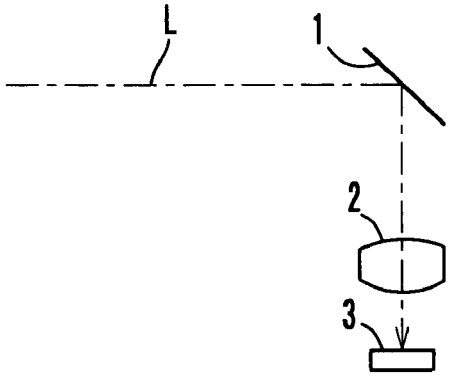
PRIOR ART FIG. 8a
FIGS. 8*a* and 8*b* are illustrations which show convergence of a laser beam to a photosensor, FIG. 8*a* showing a case of using a plane mirror and a lens, and FIG. 8*b* showing a case of using a curved mirror.
Figure 8B:
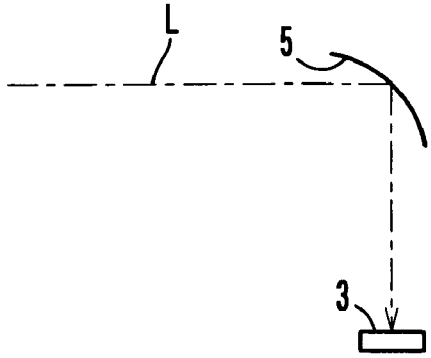

FIG. 1 shows a converging mirror 10 produced by a drawing method according to the present invention. The mirror 10 is made of an aluminum alloy plate, and substantially in the center of the mirror 10, a reflective surface 11 which is a true circle free curved surface is formed by drawing. This mirror 10 is capable of replacing the converging mirror 5 shown in FIG. 8*b* which has been used to obtain an SOS signal.

Figure 2:
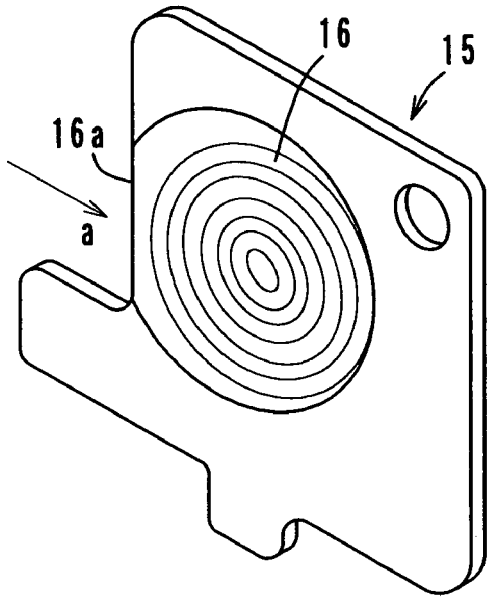
FIG. 2 is a perspective view of another exemplary mirror which is produced by a drawing method according to the present invention.

FIG. 2 shows another converging mirror 15 produced by a drawing method according to the present invention. This mirror 15 is made of an aluminum alloy plate, and a reflective curved surface 16 which is a free curved surface is formed by drawing, a part of the reflective surface 16 being cut off. The mirror 15 is also used to obtain an SOS signal. The cut portion 16*a* faces to a main scanning direction of the laser beam shown by arrow "a".

Figure 3:
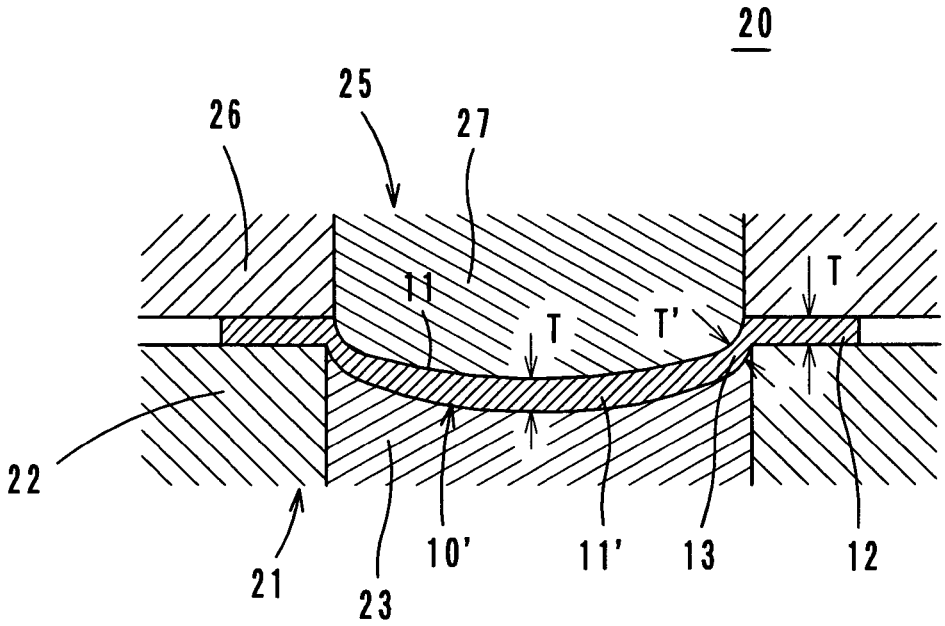
FIG. 3 is a sectional view showing a state in which a metal plate is pressed in a die assembly according to the present invention.

Next, referring to FIG. 3, a drawing die assembly and a drawing method for producing the mirror 10 are described.

A drawing die assembly 20 generally comprises a fixed die 21 and a movable die 25. The fixed die 21 is composed of a lower die 22 and a core 23, and the movable die 25 is composed of an upper die 26 and a presser 27. The presser 27 has a lower surface (pressing surface) which is accurately formed into a free curved surface identical to the reflective surface 11. The core 23 has an upper surface (receiving surface) which is formed into the free curved surface. The core 23 is positioned at a clearance from the pressing surface of the presser 27, the clearance being equal to the thickness of the reflective surface 11.

The aluminum alloy plate 10', which is a workpiece with a thickness of T, is fitted on the fixed die 21 with the movable die 25 lifted, and next, the movable die 25 is moved down to carry out drawing. The peripheral part (non-pressed portion) of the aluminum alloy plate 10' keeps to have the thickness T. The reflective curved surface pressed portion 11' is pressed between the core 23 and the presser 27 and formed into the free curved surface by drawing. In this embodiment, the center of the reflective curved surface pressed portion 11' keeps to have the thickness T.

The border portion 13 between the non-pressed portion 12 and the pressed portion 11' is compressed at a specified rate. The rate of the thickness T' after drawing to the thickness T before drawing is, for example, within a range from 70% to 90%. The circumference of the core 23 and the circumference of the presser 27 have shapes to compress the border portion 13 at the specified rate.

The mirror 15 can be produced by the same method by using a die which has a portion to form the cut portion 16*a*.

By a conventional drawing method for producing a mirror, the border portion 13 is not compressed, and due to the shape of the pressed portion 11', the amount of spring back caused by a bending process is uneven. Consequently, the reflective surface 11 formed by this method is low in accuracy. According to the present embodiment, however, the border portion 13 is compressed, and thereby, the amount of spring back becomes even regardless of the shape of the pressed portion 11'. Consequently, the reflective surface 11 formed by this method is high in accuracy.

The above-described drawing die assembly 20 is of a simple structure which comprises a fixed die 21 composed of a lower die 22 and a core 23, and a movable die 25 composed of an upper die 26 and a presser 27, and therefore, production of mirrors 10 and 15 is efficient.

The present inventors made mirrors 10 of the structure shown by FIG. 1 by the above-described drawing method and conducted experiments with the mirrors 10. FIGS. 4 through 7 show the data about the beam converging performances of the mirrors 10. In producing the mirrors 10, the inventors used the die assembly 20 shown by FIG. 3 and used an aluminum alloy plate with a thickness of 0.5 mm (XL FS003-H18 made by Sumitomo Light Metals Co., Ltd.) as a workpiece.

Figure 4:
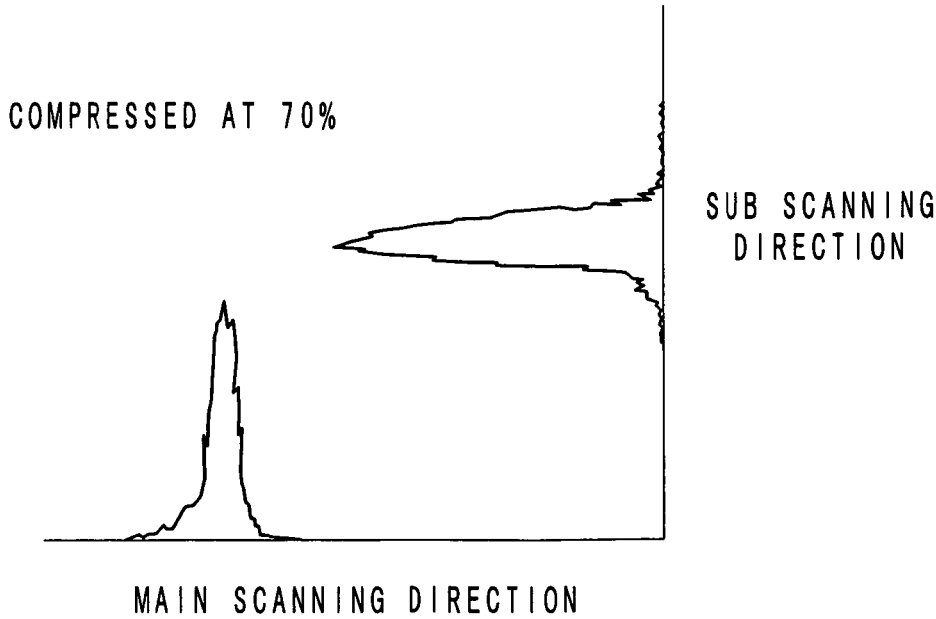
FIG. 4 is a graph which shows a beam converging performance of a mirror of which border portion was compressed to have a thickness which is 70% of the thickness of the metal plate before drawing.
Figure 5:
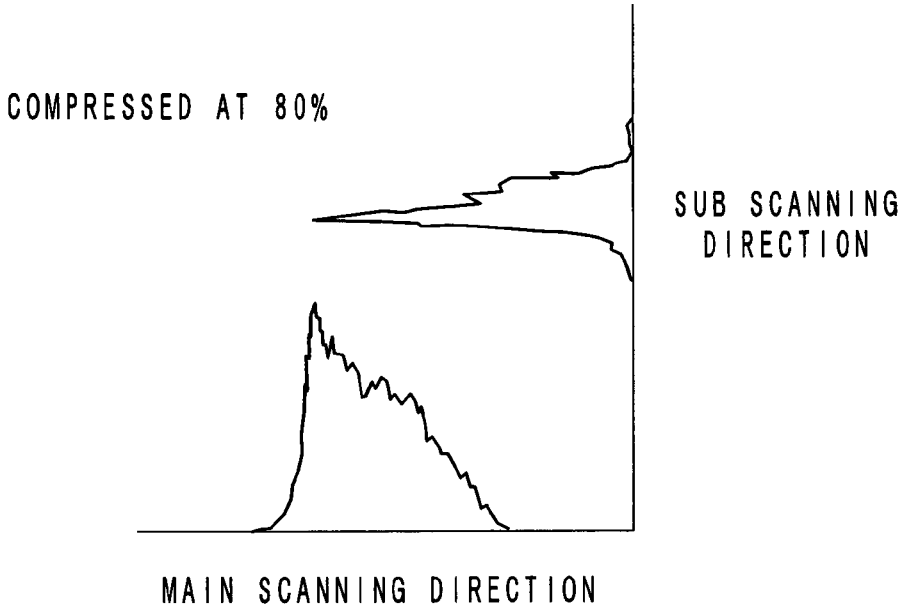
FIG. 5 is a graph which shows a beam converging performance of a mirror of which border portion was compressed to have a thickness which is 80% of the thickness of the metal plate before drawing.
Figure 6:
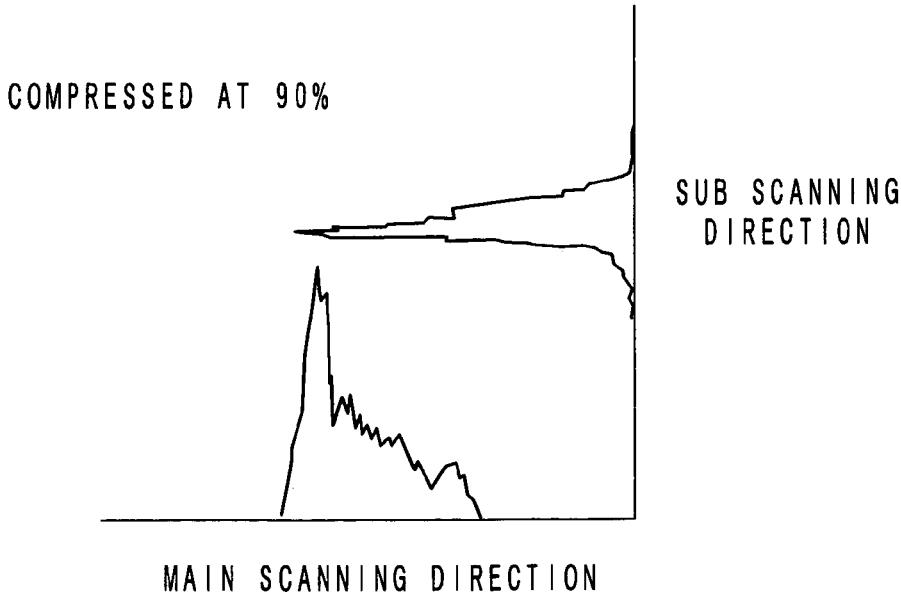
FIG. 6 is a graph which shows a beam converging performance of a mirror of which border portion was compressed to have a thickness of which is 90% of the thickness of the metal plate before drawing.
Figure 7:
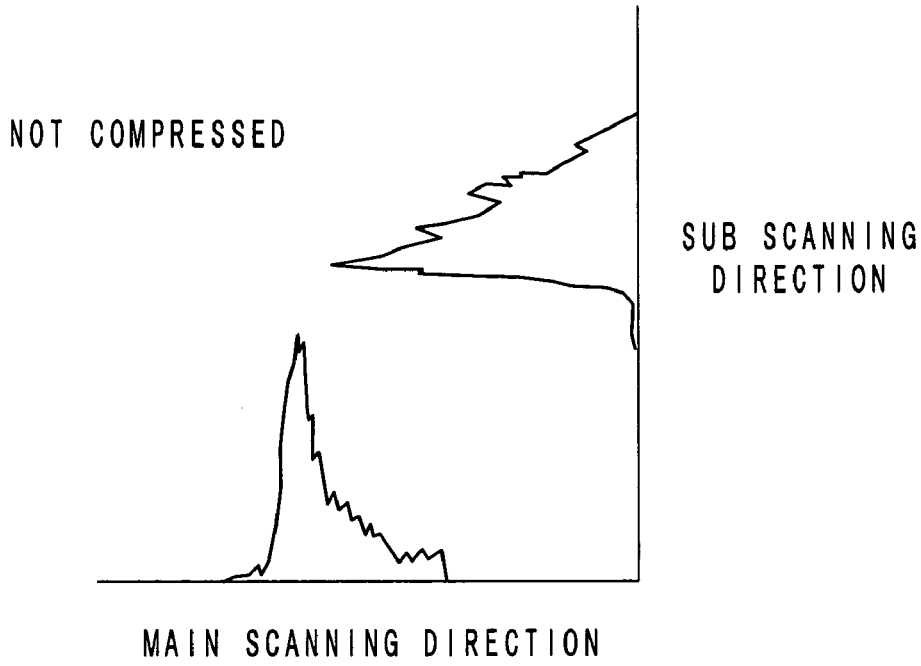
FIG. 7 is a graph which shows a beam converging performance of a mirror of which border portion was not compressed at all.

While varying the compression rate of the border portion 13 and specifically setting the compression rate to 70%, 80%, 90% and 100% (not compressed), the quantity of light on the focus was measured. FIG. 4 shows a case in which the compression rate was 70%. FIG. 5 shows a case in which the compression rate was 80%. FIG. 6 shows a case in which the compression rate was 90%. FIG. 7 shows a case in which the compression rate was 100% (no compression at all). In each graph of FIGS. 4 through 7, the quantity of light in a main scanning direction is plotted in the direction of axis of abscissas, and the quantity of light in a sub scanning direction is plotted in the direction of axis of ordinate.

As a result of the experiment, the mirror of which border portion 13 was compressed to have a 70% thickness (see FIG. 4) made the most desirable light converging performance in the main scanning direction and in the sub scanning direction. The mirrors of which border portions were compressed to have a 80% thickness and to have a 90% thickness respectively (see FIGS. 5 and 6) made good light converging performances in the sub scanning direction. The mirror of which border portion was not compressed at all (see FIG. 7) showed uneven light convergence both in the main scanning direction and in the sub scanning direction.

As is apparent from these data, the mirrors of which border portions 13 were compressed at a rate within a range from 70% to 90% made good light converging performances, and therefore, it can be inferred that the reflective surfaces 11 of these mirrors are high in accuracy. The inventors also made mirrors by the same method by using an aluminum alloy plate which was of the same material as that used in the above-described experiment but which was 1.0 mm in thickness, and the light converging performances of these mirrors were examined. In results, the same characteristic as shown by FIGS. 4 through 7 was seen. Further, it was practically impossible to compress the border portion 13 to have a thickness less than 70%, and the inventors could not collect data about a case in which the compression rate is less than 70%.

OTHER EMBODIMENTS

The details of the fixed die and the movable die of the die assembly can be designed arbitrarily. The reflective surface of a mirror can be formed into not only a free curved surface but also any other curved surfaces such as a spherical surface, a cylindrical surface, an aspherical surface, etc. A mirror which is obtained by adopting the drawing method according to the present invention or by using a drawing die assembly according to the present invention can be used as a reflective element with a converging function for various purposes as well as a reflective element to obtain an SOS signal.

Although the present invention has been described in connection with the preferred embodiments above, it is to be noted that various changes and modifications are possible to those who are skilled in the art. Such changes and modifications are to be understood as being within the scope of the present invention.

What is claimed is:

1. A drawing method for forming a reflective curved surface of a converging mirrors, comprising pressing a metal plate fitted in a fixed die with a movable die so as to have a compressed border portion between a non-pressed portion and the reflective curved surface pressed portion, the border portion being compressed to have a thickness which is at least 70% of a thickness of the metal plate before drawing, and drawing the compressed metal plate to form the reflective curved surface of a converging mirror.

2. A drawing method according to claim 1, wherein the reflective curved surface is a spherical surface, an aspherical surface, a free curved surface or a cylindrical surface.

3. A drawing method according to claim 1, wherein the metal plate is an aluminum alloy plate.

4. A drawing method according to claim 1, wherein the reflective curved surface is a free curved surface and a portion of the converging mirror connected to the free curved surface is compressed.

5. A drawing method according to claim 1, wherein the border portion of the metal plate is compressed to have a thickness which is within a range from 70% to 90% of a thickness of the metal plate before drawing.

* * * * *

UNITED STATES PATENT AND TRADEMARK OFFICE

CERTIFICATE OF CORRECTION

PATENT NO. : 7,322,224 B2
APPLICATION NO. : 10/764536
DATED : January 29, 2008
INVENTOR(S) : Koji Ohashi et al.

It is certified that error appears in the above-identified patent and that said Letters Patent is hereby corrected as shown below:

In the claims:

In claim 1, column 5, line 13, replace “mirrors” with --mirror--

Signed and Sealed this

Twenty-fourth Day of June, 2008

JON W. DUDAS
*Director of the United States Patent and Trademark Office*